US005158276A

United States Patent [19]

Toma

[11] Patent Number: 5,158,276

[45] Date of Patent: Oct. 27, 1992

[54] SHEET FEEDING APPARATUS

[75] Inventor: Akihiro Toma, Tokyo, Japan

[73] Assignee: Canon Kabushiki Kaisha, Tokyo, Japan

[21] Appl. No.: 740,875

[22] Filed: Jul. 31, 1991

Related U.S. Application Data

[63] Continuation of Ser. No. 340,262, Apr. 19, 1989, abandoned.

[30] Foreign Application Priority Data

Apr. 20, 1988 [JP] Japan ..... 63-097147

[51] Int. Cl.[5] ..... B65H 3/44

[52] U.S. Cl. ..... 271/9; 271/164

[58] Field of Search ..... 271/9, 162, 164

[56] References Cited

U.S. PATENT DOCUMENTS 4,436,406 3/1984 Murasaki ..... 271/9 X 4,569,586 2/1986 Koyama ..... 271/9 X

*Primary Examiner*—Richard A. Schacher

*Attorney, Agent, or Firm*—Fitzpatrick, Cella, Harper & Scinto

[57] ABSTRACT

The invention relates to a sheet feeding apparatus comprising a first mounting position for mounting a first accommodating device accommodating sheets therein, a second mounting position for mounting a second accommodating device accommodating sheets therein, a first sheet feeding device for feeding the sheet from the first accommodating device mounted to the first mounting position, a second sheet feeding device for feeding the sheet from the second accommodating device mounted to the second mounting position, and a support means for supporting the first accommodating device or for supporting a third accommodating device accommodating sheets therein and having such a size as to occupy the first and second mounting positions in a position where the sheet can be fed by the first sheet feeding device from the first or third accommodating device.

18 Claims, 11 Drawing Sheets

SHEET FEEDING APPARATUS

This application is a continuation of application Ser. No. 07/340,262 filed Apr. 19, 1989, now abandoned.

BACKGROUND OF THE INVENTION

1. Field of the Invention

The present invention relates to a sheet feeding apparatus, and, more particularly, it relates to a sheet feeding apparatus of sheet cassette mounting or loading type, wherein a sheet cassette within which a plurality of sheets (cut sheets and the like) are stacked is inserted in a cassette insertion portion formed in a body of the apparatus and the sheets are fed one by one at a prescribed timing toward a predetermined sheet processing position by means of feeding means provided in the body of the apparatus.

2. Related Background Art

Such a sheet feeding apparatus of sheet cassette mounting type has been widely used with a conventional recording apparatus such as an electronic copying machine, electrostatic copying machine, laser beam printer, easy printer and the like, in order to automatically feed the sheets (transfer sheets, photosensitive sheets, recording sheets, printing sheets and the like) one by one toward an image forming mechanism of the recording apparatus by means of feeding means.

With this arrangement, so long as a plurality of cassettes which have the same size and/or quality of stacked sheets in the same cassette but have a different size and/or quality from those of the sheets in other cassettes, are prepared in advance, it is possible to change the kinds of sheet merely by inserting a cassette including a desired kind of sheets into the cassette insertion portion formed in the body of the recording apparatus. Thus, it is very convenient and is easy to handle and store the sheets.

Alternatively, a multi-layer cassette system has also been adopted. In this case, a plurality of cassette insertion portions are formed in the body of the recording apparatus, and the cassettes, each including the different kind of sheets, are inserted into the respective cassette insertion portions. An operator designates or selects a desired sheet by the use of selection designation means provided on the recording apparatus so that the feeding means associated with the cassette including the desired sheet are selectively actuated. With this arrangement, since the kinds of sheet to be fed to the recording apparatus can be changed by manipulating selection buttons of the selection designation means, the operability is further improved.

Such conventional sheet feeding apparatus of multi-layer (three layers) cassette mounting type is shown in FIGS. 7A and 7B, where FIG. 7A is a side sectional view and FIG. 7B is a rear view of the apparatus.

In these Figures, a body 1 of a recording apparatus such as an electronic copying machine has three (upper, intermediate, lower) cassette insertion portions $\mathbf{20_1}$, $\mathbf{20_2}$ and $\mathbf{20_3}$ formed therein, into which sheet cassettes 30*a*, 30*b* and 30*c* can be removably inserted; feeding means $\mathbf{21_1}$, $\mathbf{21_2}$, $\mathbf{21_3}$ arranged in correspondence with the respective cassette insertion portions; portions; regist rollers (or relay feed rollers) 23; and sheet paths (sheet guide passages) $\mathbf{22_1}$, $\mathbf{22_2}$ and $\mathbf{22_3}$ extending between the regist rollers 23 and the corresponding feeding means $\mathbf{21_1}$, $\mathbf{21_2}$ and $\mathbf{21_3}$.

Each of the sheet cassettes 30*a*, 30*b* or 30*c* includes sheets of different kind (from those in other cassettes) (for, example, A4 size, B4 size, B5 size and the like) stacked therein. When the cassette 30*a*, 30*b* or 30*c* is inserted into one of the cassette insertion portions $\mathbf{20_1}$, $\mathbf{20_2}$ or $\mathbf{20_3}$ completely, the kinds of the sheets housed in the sheet cassette inserted into the cassette insertion portions are detected by means of detection means (not shown), and the detected kinds (of the sheet) are displayed on a displayer of the selection means arranged on a console panel (not shown) of the body 1 of the recording apparatus.

Now, when the operator selects or designates a desired kind (of the sheet) from among a plurality of kinds displayed on the displayer, only one of the feeding means $\mathbf{21_1}$, $\mathbf{21_2}$ or $\mathbf{21_3}$ corresponding to the cassette insertion portion $\mathbf{20_1}$, $\mathbf{20_2}$ or $\mathbf{20_3}$ into which the sheet cassette 30*a*, 30*b* or 30*c* including the designated kind of sheets is inserted is in a operable condition, and said feeding means is controlled to be actuated at a predetermined timing. In this way, the sheets (of the designated kind) are fed one by one from said sheet cassette, and then, each sheet passes through the corresponding sheet path $\mathbf{22_1}$, $\mathbf{22_2}$ or $\mathbf{22_3}$, the regist rollers 23 and a sheet passage 24, and is fed to an image transferring position and other sheet processing positions (not shown) in the body 1 of the recording apparatus.

In the above-mentioned conventional sheet feeding apparatus of multi-layer cassette mounting type, each of openings of the cassette insertion portions $\mathbf{20_1}$, $\mathbf{20_2}$ or $\mathbf{20_3}$ is configurated for the purpose of receiving any cassettes of the same size (to have the same maximum capacity for accommodating the same numbers of sheets regardless of the kinds of the sheet). To this end, the openings of the cassette insertion portions are formed to have the same configuration by partition plates 25 positioned between the cassette insertion portions. However, such arrangement results in the following drawbacks:

(1) When it is desired that the sheets of one size are to be used in greater quantities than the sheets of other sizes, the user or operator must frequently replenish the empty cassette with new sheets of the specific size or change the empty cassette to a new cassette including the sheet of the specific size. Therefore, the recording operation is interrupted frequently each time the sheets are replenished or the cassettes are changed, during the operation of the recording apparatus itself. In order to reduce the interruption of the recording operation, a cassette having a larger capacity may be used for the sheet of the specific size in question. However, such cassette having the larger capacity cannot be inserted in any cassette insertion portions $\mathbf{20_1}$, $\mathbf{20_2}$ or $\mathbf{20_3}$ of the recording apparatus, and thus, cannot be used with such recording apparatus. (2) On the other hand, if cassette insertion portions corresponding to the cassette having the larger capacity are formed in the body of the recording apparatus, the opening of each cassette insertion portion will be large-sized. Consequently, a plurality of feeding means cannot be provided in the recording apparatus, with the result that the request presented by the user or operator who wishes to use a various kinds of sheets cannot be satisfied.

SUMMARY OF THE INVENTION

Accordingly, it is an object of the present invention to provide a sheet feeding apparatus of sheet cassette mounting or loading type wherein various sheet cassettes having various sizes and various sheet accommodating capacities can be freely used and mounted thereon. With this sheet feeding apparatus, the drawbacks as mentioned in the above items (1) and (2) can be eliminated.

In other words, it is an object of the present invention to provide a sheet feeding apparatus of sheet cassette mounting type which is simple in construction and wherein various sheet cassettes having various sheet accommodating capacities can be freely mounted thereon at the operator's need.

In order to achieve the above-mentioned object, the present invention provides a sheet feeding apparatus of sheet cassette mounting type wherein a plurality of sheet cassettes each accommodating the sheets can be inserted into a cassette insertion portion formed in a body of the apparatus and sheets are fed one by one from one of the sheet cassettes, and further wherein a plurality of feeding means are provided in association with a single cassette insertion portion, the same number of the sheet cassettes as the number of the feeding means can be mounted into the single cassette insertion portion, and a sheet cassette having a different sheet accommodating capacity can also be mounted in said cassette insertion portion across the plurality of feeding means.

With this arrangement, by mounting the same number of sheet cassettes (as the number of the feeding means provided in the single cassette insertion portion) in the cassette insertion portion, as in the case of the conventional sheet feeding apparatus of multi-layer cassette mounting type, it is possible to selectively actuate the feeding means corresponding to the cassette including a desired kind of sheets by designating the desired kind of sheets through the selection designation means so that the desired sheets can be automatically fed one by one from the cassette successively. That is to say, only when a plurality of sheet cassettes each having a smaller capacity and including a respective kind of sheets are previously inserted into the single cassette insertion portion, it is possible to easily and frequently change the kinds of sheet to be used, only by manipulating the selection buttons of the selection designation means.

On the other hand, when all of the sheet cassettes of the smaller capacities are removed or dismounted from the single cassette insertion portion and a single sheet cassette having a larger capacity corresponding to a space in the cassette insertion portion is inserted into the cassette insertion portion, or when two or more adjacent sheet cassettes of the smaller capacities are removed from the cassette insertion portion and a single sheet cassette having an intermediate capacity corresponding to a space obtained by the removal of these smaller cassettes is inserted into the cassette insertion portion, the sheets can be automatically fed one by one successively from the larger or intermediate cassette by means of an uppermost feeding means among the plurality of feeding means across which the larger or intermediate cassette is mounted.

That is to say, if it is desired to particularly use the sheets of specific size or quality in greater quantities than the other sheets, by using the sheet feeding apparatus in a condition that such larger or intermediate cassette is inserted into the cassette insertion portion, it is possible to reduce the frequency in the replenishment of the sheets and/or the change of the cassettes, and, therefore, the frequency in the interruption of the recording operation considerably.

BRIEF DESCRIPTION OF THE DRAWINGS

FIG. 1 shows a sheet feeding apparatus according to a first embodiment of the present invention, wherein

FIG. 2 shows a construction of locking means, wherein

FIG. 4 shows a sheet feeding apparatus according to a second embodiment of the present invention, wherein

FIG. 5 shows a sheet feeding apparatus according to a third embodiment of the present invention, wherein

FIG. 6 shows a sheet feeding apparatus according to a fourth embodiment of the present invention, wherein

FIG. 7 shows a conventional sheet feeding apparatus, where

DETAILED DESCRIPTION OF THE PREFERRED EMBODIMENTS

FIGS. 1 and 2 show a first embodiment of the present invention.

Figure 1A:
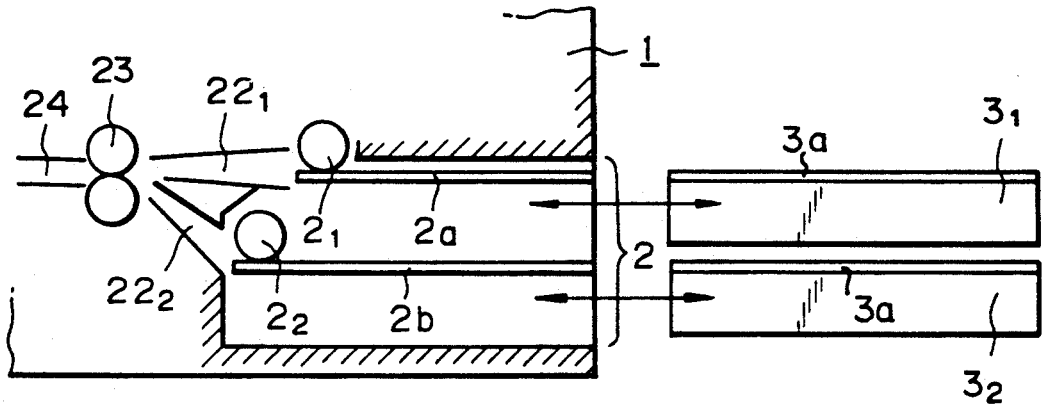
FIG. 1A is a longitudinal sectional view of the sheet feeding apparatus before sheet cassettes are mounted or after the sheet cassettes are dismounted.

In this first embodiment, as shown in FIG. 1A, a single cassette insertion portion 2 having a larger height is formed in a body 1 of the sheet feeding apparatus, and two (upper and lower) sheet feeding means (feed rollers) $2_1$ and $2_2$ are arranged in the inner part of the cassette insertion portion 2. Guide slots 2*a* are formed in both side walls of the cassette insertion portion 2 at a level of the upper sheet feeding means $2_1$. Similarly, guide slots 2*b* are also formed in both side walls of the cassette insertion portion 2 at a level of the lower sheet feeding means $2_2$. These guide slots 2*a* and 2*b* extend from an inlet of the cassette insertion portion to the respective sheet feeding means in substantially horizontal directions, respectively.

Sheet cassettes $3_1$ and $3_2$ having the same smaller capacities can be inserted into the cassette insertion portion in an overlapped relation. Guide ridges (projecting upper edges) 3*a* which can engage with the guide slots 2*a* or 2*b* formed in the transverse walls of the cassette insertion portion 2 are formed on upper ends of both transverse or side walls of the sheet cassettes $2_1$ and $2_2$, respectively (see FIG. 1C).

Figure 1B:
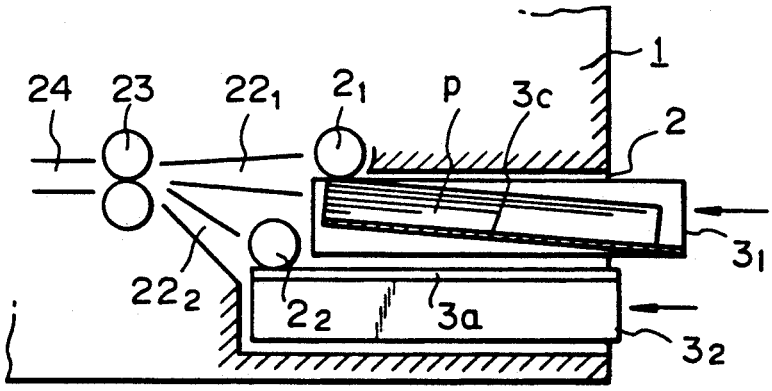
FIG. 1B is a longitudinal sectional view in a condition that the sheet cassettes are mounted on the sheet feeding apparatus.
Figure 1C:
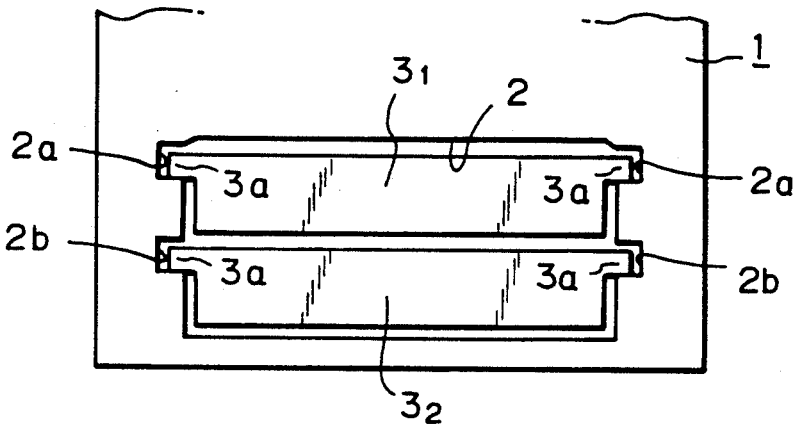
FIG. 1C is a rear view of the apparatus of FIG. 1B.

One of the sheet cassettes $3_1$ or $3_2$ is mounted in the cassette insertion portion 2 by inserting it into the cassette insertion portion completely while engaging the guide ridge 3*a* thereof by the upper guide slots 2*a* of the cassette insertion portion 2, and the other sheet cassette $3_2$ or $3_1$ is also mounted in the cassette insertion portion 2 by inserting it into the cassette insertion portion completely while engaging the guide ridge 3*a* thereof by the lower guide slots 2*b* of the cassette insertion portion 2. In the way, two sheet cassettes $3_1$, $3_2$ are mounted in the cassette insertion portion 2 in the overlapped relation in an up-and-down direction, as shown in FIGS. 1B and 1C.

When the sheet cassettes $3_1$, $3_2$ are fully or completely inserted in the cassette insertion portion 2 in the above-mentioned manner, the respective cassettes are locked in their mounted positions by means of the corresponding locking means.

Figure 2A:
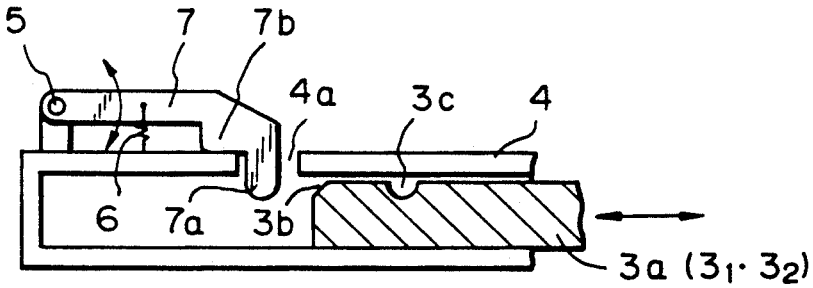
FIG. 2A is a sectional view of the locking means in an unlocked condition and FIG. 2B is a sectional view of the locking means in a locked condition.

One example of such locking means is shown in FIG. 2. Each locking means comprises a locking arm 7 pivotally mounted, through a support shaft, on an upper outer surface of a channel member 4 forming the guide slot 2*a* or 2*b* along which the guide ridge 3*a* of the cassette $3_1$ or $3_2$ is guided and normally biased in a clockwise direction by means of a corresponding spring 6. The channel member 4 is provided with a through opening 4*a* through which a downwardly extending projection 7*a* formed on the free end of the locking arm 7 can pass. When the cassette is not mounted in the cassette insertion portion, as shown in FIG. 2A, the locking arm 7 has been rotated in a clockwise direction by the pulling action of the spring 6 until a stopper shoulder 7*b* of the locking arm is abutted against the upper outer surface of the channel member 4, where a tip or free end of the downwardly extending projection 7*a* of the locking arm passed through the through opening 4*a* of the channel member penetrates into the guide slot 2*a* or 2*b*.

Figure 2B:
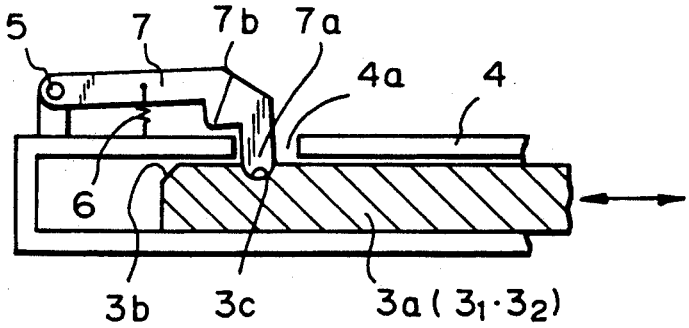

When the cassette $3_1$ or $3_2$ is inserted into the cassette insertion portion 2 while engaging the guide ridge 3*a* thereof by the corresponding guide slot 2*a* or 2*b*, at a point before the cassette is completely inserted into the cassette insertion portion, an inclined cam surface 3*b* formed on an upper edge of a leading end of the guide ridge 3*a* of the cassette abuts against the free end of the projection 7*a* of the locking arm 7. As the cassette $3_1$ or $3_2$ is further pushed against the resistance due to such abutment, the locking arm 7 is rotated around the support shaft 5 in an anti-clockwise direction against the action of the spring 6 by the inclined cam surface 3*b* to ride on the upper surface of the guide ridge 3*a*. Subsequently, as shown in FIG. 2B, the downwardly extending projection 7*a* of the locking arm is engaged by a locking recess 3*c* formed in the upper surface of the guide ridge 3*a* of the cassette. In this point, the cassette has reach a predetermined mounted position where the cassette is stably held in the mounted condition through the engagement between the projection 7*a* and the locking recess 3*c*.

On the other hand, if the mounted cassette $3_1$ or $3_2$ is dismounted from the cassette insertion portion 2, the cassette is pulled or withdrawn in a cassette removal direction with a force stronger than a cassette holding force due to the engagement between the projection 7*a* and the locking recess 3*c*. As a result, the locking arm is rotated in an anti-clockwise direction against the action of the spring 6 to disengage the projection 7*a* of the locking arm from the locking recess 3*c* of the cassette, thus releasing the cassette from the locking means. Subsequently, the cassette can be easily pulled out of the cassette insertion portion without any resistance.

In the mounted condition where the two cassettes $3_1$, $3_2$ are received in the cassette insertion portion 2 in the overlapped relation as shown in FIGS. 1B and 1C, the kinds of the sheets accommodated in the two mounted cassettes are detected by detection means (not shown), respectively, and the detected kinds of the sheets are displayed on a displayer of the selection designation means arranged on a console panel (not shown) of the body 1 of the apparatus.

When the operator selects or designates the desired kinds of sheet from among the display kinds of sheet, only the sheet feeding means $2_1$ or $2_2$ corresponding to the cassette $3_1$ or $3_2$ including the designated sheets can be actuated. In this way, such sheet feeding means $2_1$ or $2_2$ is controlled to be actuated to feed the designated sheets one by one toward a predetermined sheet processing position in the body 1 of the apparatus through a sheet path $22_1$ or $22_2$, regist rollers 23 and sheet passage 24.

Figure 3:
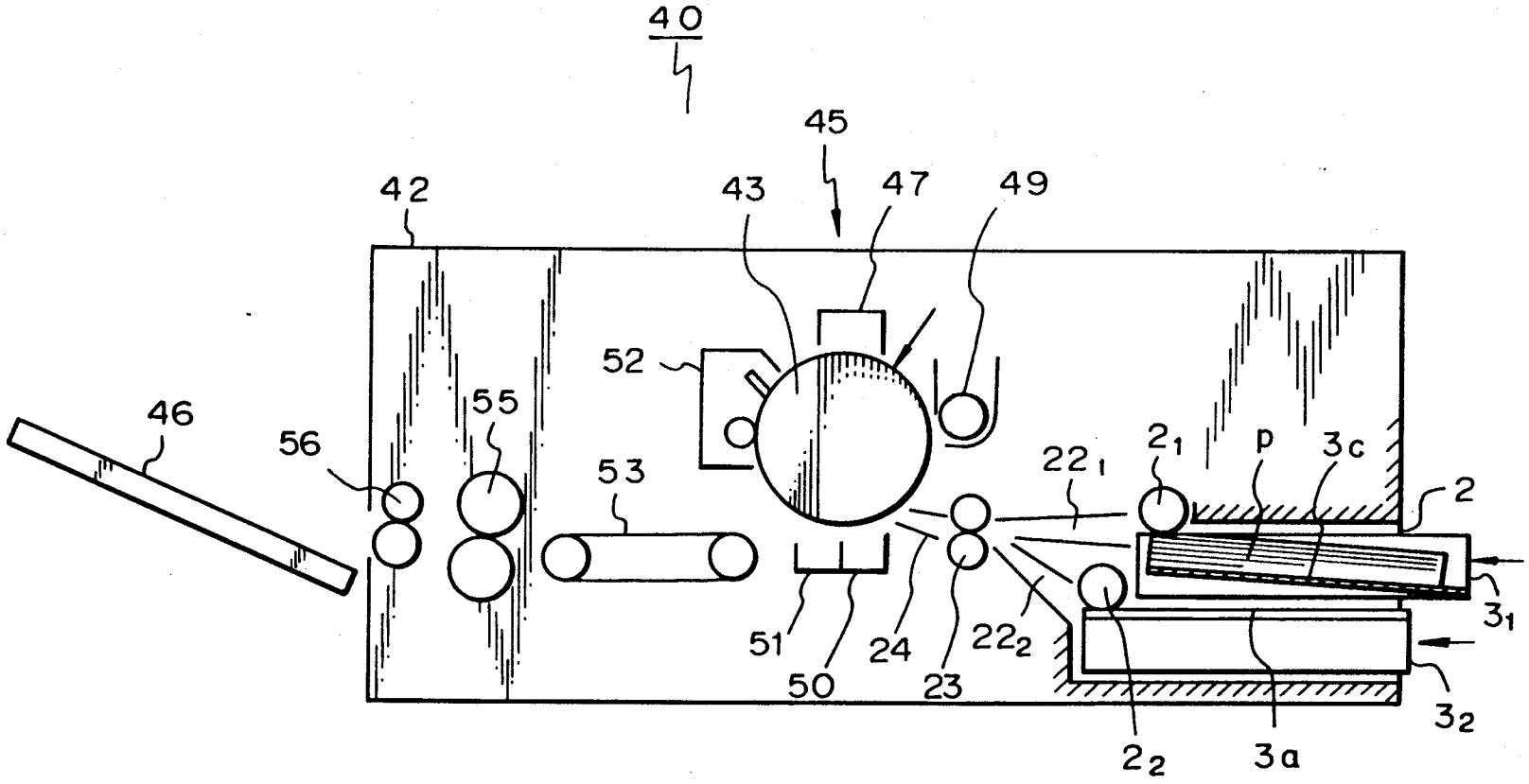
FIG. 3 is an explanatory view showing an example that the sheet feeding apparatus of the first embodiment is applied to an image forming apparatus.

FIG. 3 is an explanatory view showing an example that the present invention is incorporated into a body of the apparatus 40 (a printer as an image forming apparatus).

As shown in FIG. 3, the printer 40 includes an image forming portion 45 comprising a photosensitive drum 43 arranged within a frame 42 of the printer at a substantially central position thereof, and a sheet ejector tray 46 arranged on a left side (FIG. 3) of the printer frame. In the image forming portion 45, a primary charger 47, developing device 49 including developer such as toner therein, transfer charger 50, separation charger 51 and cleaner 52 are arranged around the photosensitive drum 43. Further, a feeding belt 53, fixing device 55 and ejector rollers 56 are arranged between the image forming portion 45 and the sheet ejector tray 46.

When a sheet feeding signal is emitted, the sheet P accommodated in the cassette $3_1$ or $3_2$ is fed toward the image forming portion 45 of the printer 40 by means of the sheet feeding means $2_1$ or $2_2$ until a leading edge of the sheet P abuts against the regist rollers 23. Then, when the regist rollers 23 are actuated to initiate the conveying of the sheet P, the sheet P is skew-fed to be directed between the photosensitive drum 43 and the transfer charger 50 while being pinched by the regist rollers 23. On the other hand, the regist rollers 23 are stopped when a trailing edge of the sheet P leaves therefrom.

A toner image formed by an electrophotographic process is transferred from the photosensitive drum 43 onto the sheet P fed between the photosensitive drum 43 and the transfer charger 50, and then, the sheet P is separated from the photosensitive drum 43 by separation means such as the separation charger 51 and the like and then is conveyed by the feeding belt 53 to the fixing device 55 where the transferred image is fixed. Then, the sheet P is ejected or discharged into the ejector tray 56.

Figure 1D:
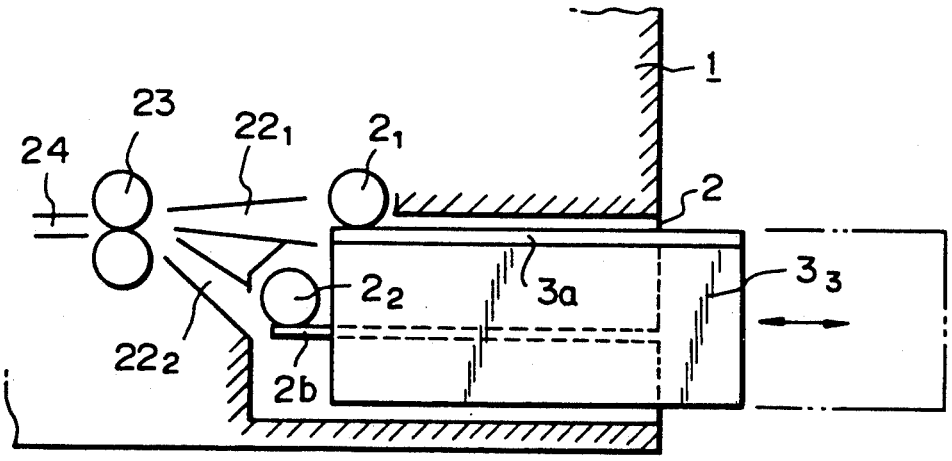
FIG. 1D is a longitudinal sectional view in a condition that a sheet cassette having a larger capacity is mounted on the sheet feeding apparatus.
Figure 1E:
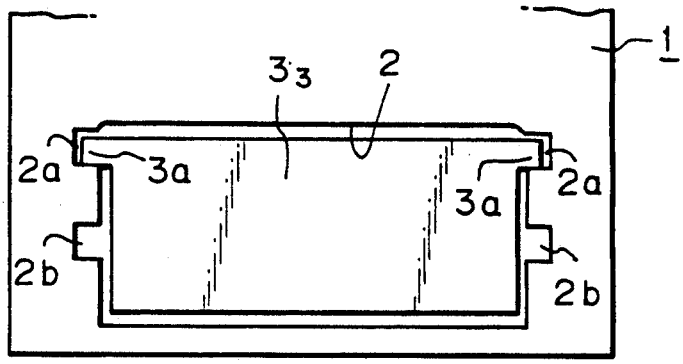
FIG. 1E is a rear view of the apparatus of FIG. 1D.

FIGS. 1D and 1E show a condition that a cassette $3_3$ having a larger capacity is mounted in the cassette insertion portion 2. In this case, the cassette $3_3$ has a sheet accommodating capacity larger than that of the cassette $3_1$ or $3_2$ by about twice. Similarly to the cassettes $3_1$, $3_2$, the cassette $3_3$ is also provided at its both upper side walls with guide ridges *3a* which can engage by the upper guide slots *2a* of the cassette insertion portion 2.

After the both of the cassettes $3_1$ and $3_2$ each having the smaller capacity are removed from the cassette insertion portion 2, the cassette $3_3$ having the larger capacity is mounted in the cassette insertion portion 2 by inserting it completely into the cassette insertion portion 2 while engaging the guide ridges *3a* thereof by the corresponding upper guide slots *2a* until the cassette $3_3$ is locked and positioned by the above-mentioned locking means 7, *3c* (FIG. 2). In this case, the cassette $3_3$ having the larger capacity is mounted across the feeding means $2_1$, $2_2$ in association with only the upper feeding means $2_1$. In this case, only the upper feeding means $2_1$ is actuated to automatically feed the sheets one by one from the cassette $3_3$ of the larger capacity.

Incidentally, as shown in FIG. 1B, each of the cassettes $3_1$, $3_2$ having the smaller capacity and the cassette $3_3$ having the larger capacity is provided with a rockable plate *3c'* on which the sheets P are stacked. Each rockable plate *3c'* is always biased in an upper direction so that the leading edge portion of the uppermost sheet P on the stack is lifted to contact with the associated feeding means $2_1$, $2_2$. Further, sheet separating pawls (not shown) are provided in the cassette to engage with the leading edge portion or side edges of the uppermost sheet. Since such construction of the cassette is already known, the detailed explanation thereof will be omitted.

FIG. 4 shows a second embodiment of the present invention.

Figure 4A:
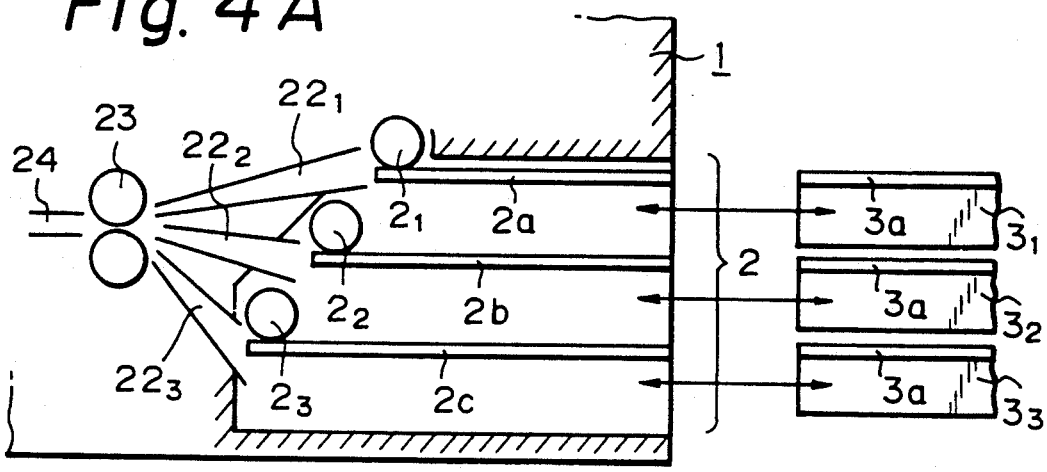
FIG. 4A is a longitudinal sectional view of the sheet feeding apparatus before sheet cassettes are mounted or after the sheet cassettes are dismounted.
Figure 4B:
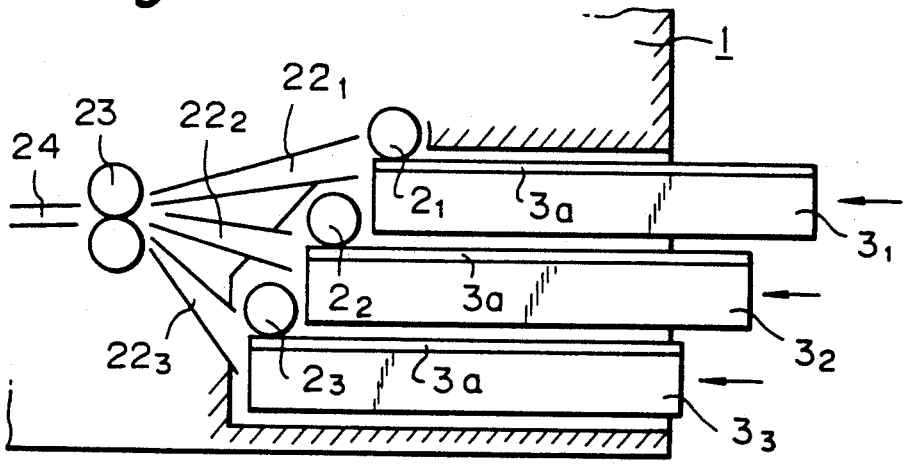
FIG. 4B is a longitudinal sectional view in a condition that the sheet cassettes are mounted on the sheet feeding apparatus.
Figure 4C:
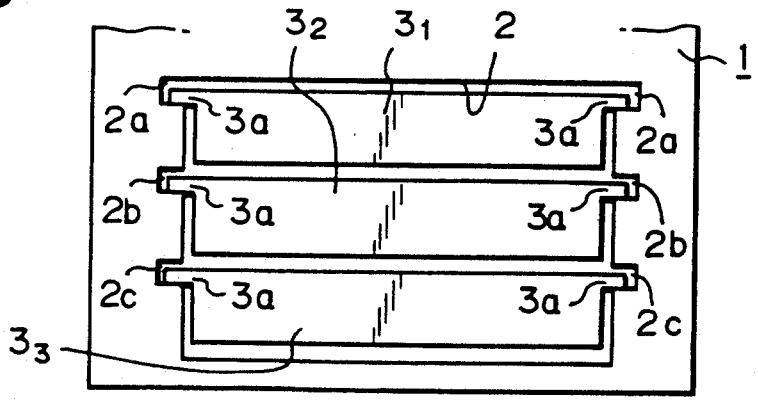
FIG. 4C is a rear view of the apparatus of FIG. 4B.

In this second embodiment, three (upper, intermediate, lower) sheet feeding means $2_1$, $2_2$ and $2_3$ are provided in association with a single cassette insertion portion 2, and, as shown in FIGS. 4B and 4C, three sheet cassettes $3_1$, $3_2$ and $3_3$ each having a smaller capacity can be inserted into the single cassette insertion portion 2 in an overlapped relation to feed the sheet from the sheet cassette $3_1$, $3_2$ or $3_3$ selectively.

Figure 4D:
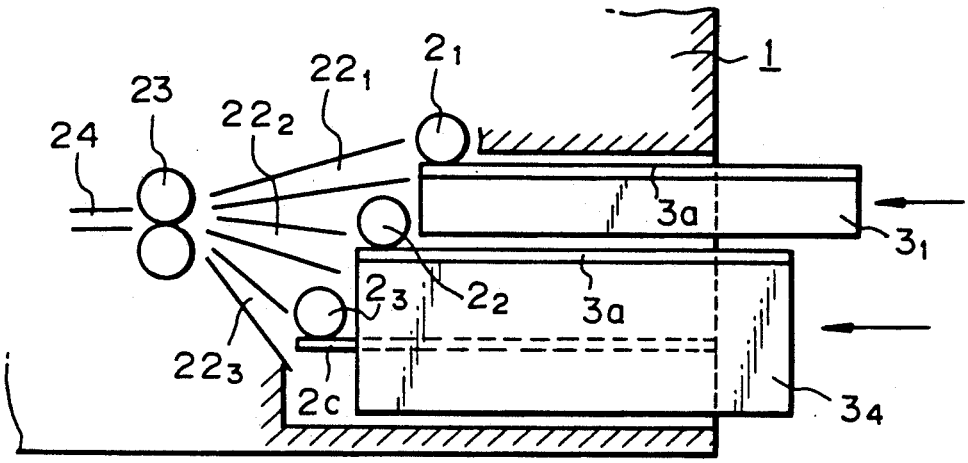
FIG. 4D is a longitudinal sectional view in a condition that a sheet cassette having an middle or medium capacity is mounted on the sheet feeding apparatus.
Figure 4E:
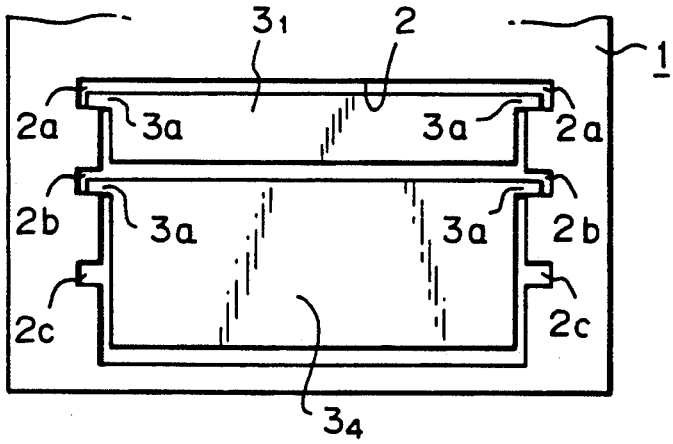
FIG. 4E is a rear view of the apparatus of FIG. 4D.

Alternatively, as shown in FIGS. 4D and 4E, after the intermediate and lower cassettes $3_2$ and $3_3$ of the smaller capacity are removed from the cassette insertion portion 2, when a sheet cassette $3_4$ having an middle sheet accommodating capacity larger than that of the cassette $3_2$, $3_3$ by about twice is inserted into space obtained by the removal of the cassettes $3_2$, $3_3$, the sheet can be selectively fed from the middle cassette $3_4$ or from the smaller cassette $3_1$.

Figure 4F:
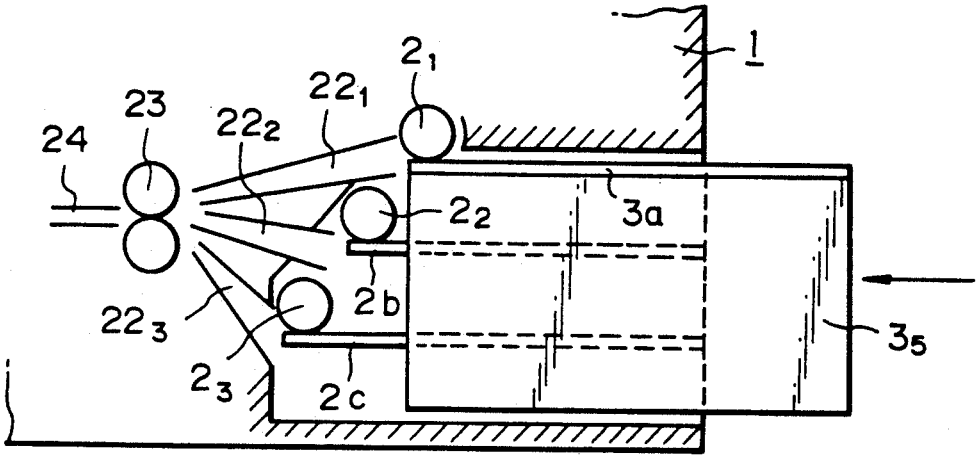
FIG. 4F is a longitudinal sectional view in a condition that a sheet cassette having a larger capacity is mounted on the sheet feeding apparatus.
Figure 4G:
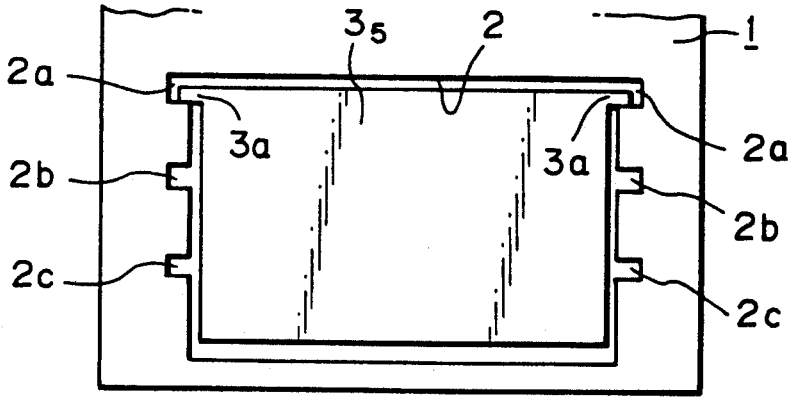
FIG. 4G is a rear view of the apparatus of FIG. 4F.

Further, as shown in FIGS. 4F and 4G, after all of the smaller cassettes $3_1$, $3_2$ and $3_3$ are removed from the cassette insertion portion 2, when a sheet cassette $3_5$ having a larger sheet accommodating capacity larger than that of the smaller cassette by about three times is inserted into the cassette insertion portion 2 in place of these smaller cassettes, the sheets in the larger cassette $3_5$ can exclusively be used.

The middle cassette $3_4$ shown in FIGS. 4D and 4E is positioned in the locked position by means of the locking means provided in association with the intermediate guide slots *2b* of the cassette insertion portion 2. Similarly, the larger cassette $3_5$ shown in FIGS. 4D and 4E is positioned in the locked position by means of the locking means provided in association with the upper guide slots *2b* of the cassette insertion portion 2.

FIG. 5 shows a third embodiment of the present invention.

In this third embodiment, the cassette insertion portion is divided into three (upper, intermediated, lower) cassette insertion portions $26_1$, $26_2$ and $26_3$ with which the sheet feeding means $2_1$, $2_2$ and $2_3$ are associated, respectively. More particularly, these cassette insertion portions are separated from each other in an up-and-down direction by means partition plates $27_1$ and $27_2$ which are removably mounted in the cassette insertion portion and on which the sheet cassettes are supported, respectively. The partition plates $27_1$, $27_2$ are normally inserted into and supported by guide recesses *28a* formed in both side walls of the cassette insertion portion, and are prevented from slipping out of the cassette insertion portion by means of pins or other appropriate fastening means (not shown), thus dividing the cassette insertion portion into three-layer (upper, intermediate, lower) cassette insertion portions $26_1$, $26_2$ and $26_3$.

Figure 5A:
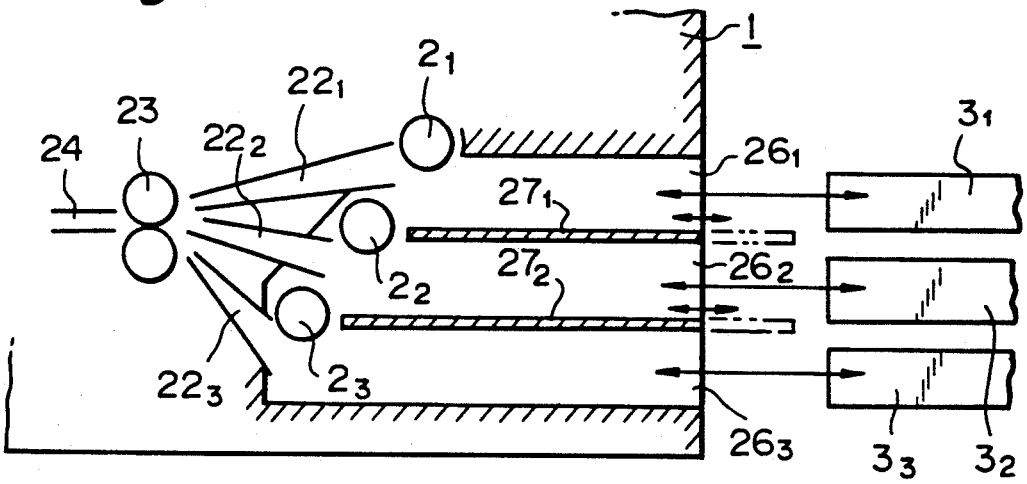
FIG. 5A is a longitudinal sectional view of the sheet feeding apparatus before sheet cassettes are mounted or after the sheet cassettes are dismounted.
Figure 5B:
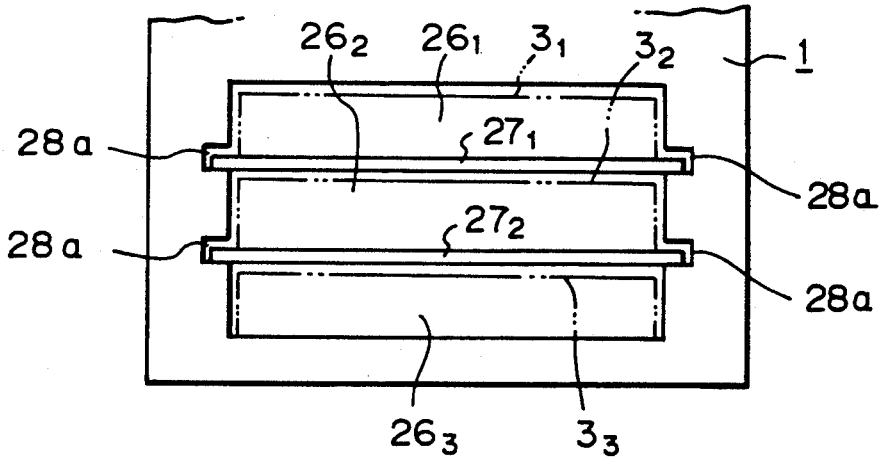
FIG. 5B is a elevational view showing a cassette insertion portion.
Figure 5C:
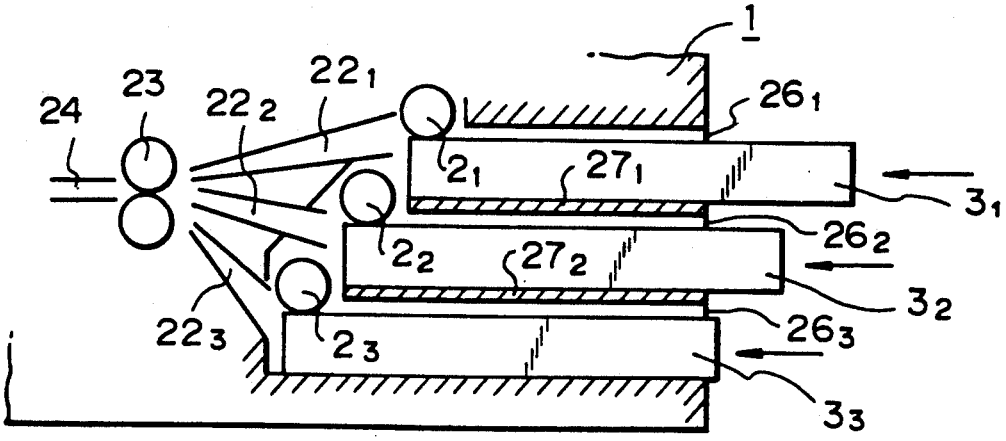
FIG. 5C is a longitudinal sectional view in a condition that the sheet cassette are mounted on the sheet feeding apparatus.
Figure 5D:
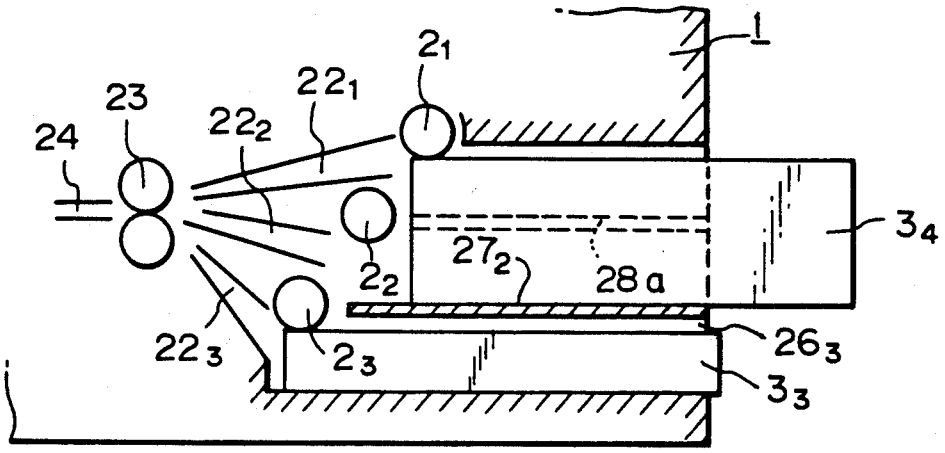
FIG. 5D is a longitudinal sectional view in a condition that a sheet cassette having an middle capacity is mounted on the sheet feeding apparatus.

As shown in FIG. 5C, when the sheet cassettes $3_1$, $3_2$ and $3_3$ each having a smaller capacity are mounted in the corresponding cassette insertion portions $26_1$, $26_2$ and $26_3$, the sheet can be fed from the sheet cassette $3_1$, $3_2$ or $3_3$ selectively.

Alternatively, after the upper partition plate $27_1$ is removed to continue or combine the upper and intermediate cassette insertion portions $26_1$, $26_2$, when the cassette $3_4$ having the middle capacity is inserted in the combined cassette insertion portion, the sheet can be fed from the middle cassette $3_4$ or from the smaller cassette $3_3$ selectively. Similarly, the lower partition plate $27_2$ may be removed to continue or combine the intermediate and lower cassette insertion portions $26_2$, $26_3$ into which the middle cassette $3_4$ can be inserted.

Figure 5E:
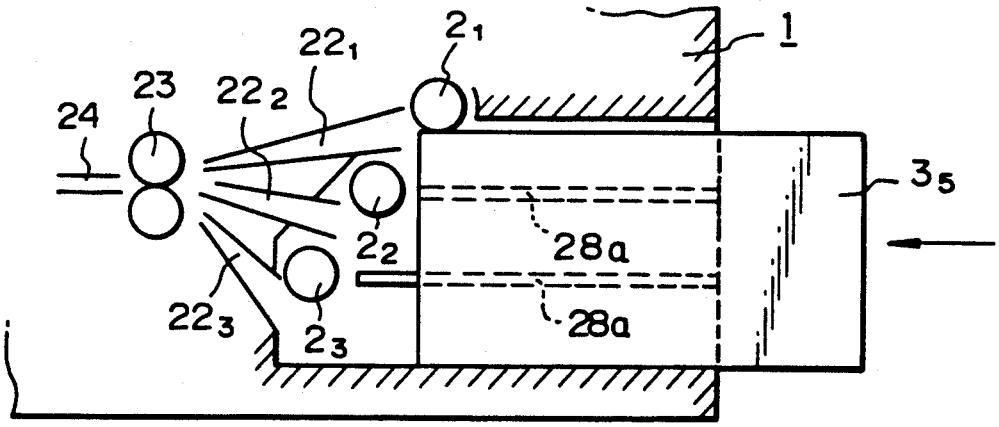
FIG. 5E is a longitudinal sectional view in a condition that a sheet cassette having a larger capacity is mounted on the sheet feeding apparatus.

Further, as shown in FIG. 5E, after both of the upper and lower partition plates $27_1$, $27_2$ are removed to combine all of the cassette insertion portions $26_1$, $26_2$ and $26_3$, when the larger cassette $3_5$ is inserted into the combined cassette insertion portion, the sheets can be fed from the larger cassette exclusively.

FIG. 6 shows a fourth embodiment of the present invention.

Figure 6A:
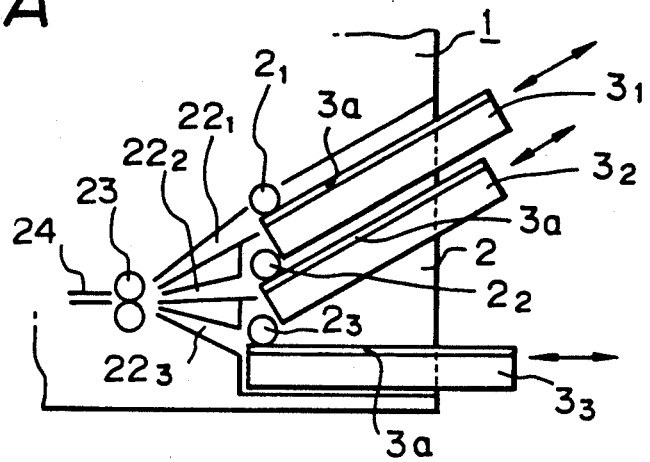
FIG. 6A is a longitudinal sectional view in a condition that the sheet cassettes are mounted on the sheet feeding apparatus.
Figure 6B:
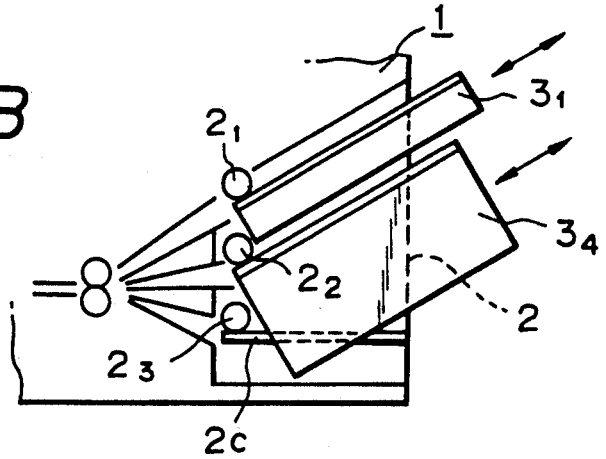
FIG. 6B is a longitudinal sectional view in a condition that a sheet cassette having a middle capacity is mounted on the sheet feeding apparatus.
Figure 6C:
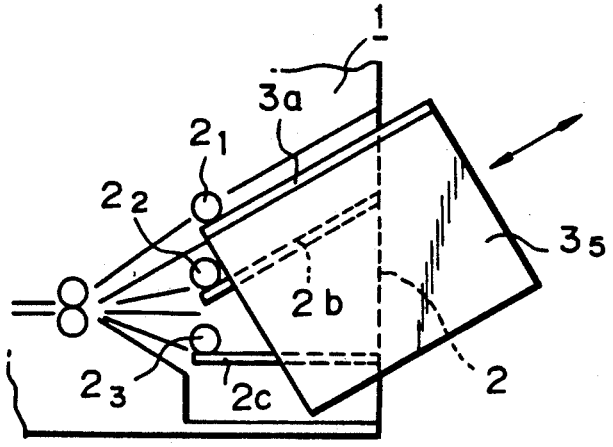
FIG. 6C is a longitudinal sectional view in a condition that a sheet cassette having a larger capacity is mounted on the sheet feeding apparatus.
Figure 7A:
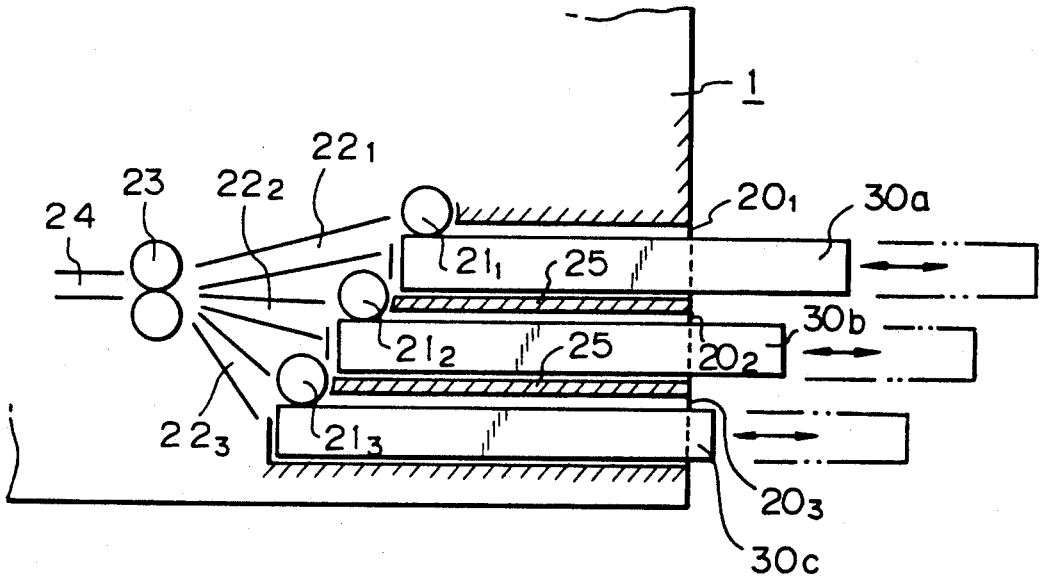
FIG. 7A is a longitudinal sectional view in a condition that the sheet cassettes are mounted on the sheet feeding apparatus.
Figure 7B:
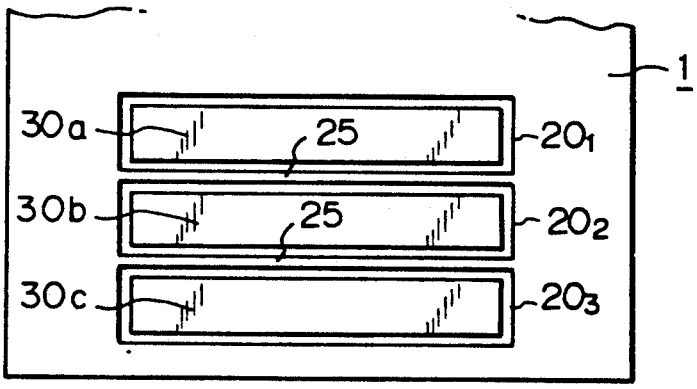
FIG. 7B is a rear view of the apparatus of FIG. 7A.

While, in the above first, second and third embodiments, the sheet feeding means $2_1$–$2_3$ associated with the respective cassette insertion portions were arranged in a staggered relation as shown in FIGS. 6A–6C, these feeding means $2_1$–$2_3$ can be arranged on a substantially vertical line, by changing an angle of the mounting of each cassette $3_1$–$3_5$ with respect to the cassette insertion portion 2. Further, the arrangement of the sheet feeding means may be optionally altered by changing the angle of the mounting of each cassette with respect to the cassette insertion portion.

I claim:

1. A sheet feeding apparatus comprising:

a first mounting station for mounting a first accommodating means accommodating sheets therein;

a second mounting station for mounting a second accommodating means accommodating sheets therein;

a first sheet feeding means for feeding the sheet from said first accommodating means mounted to said first mounting station;

a second sheet feeding means for feeding the sheet from said second accommodating means mounted to said second mounting station; and a support means for supporting said first accommodating means or for supporting a third accommodating means accommodating sheets therein and having such a size as to occupy said first and second mounting stations in a sheet feeding position, wherein said first sheet feeding means and said second sheet feeding means are vertically arranged in an upper and lower relation without offset in the horizontal direction.

2. A sheet feeding apparatus according to claim 1, further including a shift preventing means for preventing movement of said first accommodating means mounted to said first mounting station or movement of said third accommodating means.

3. A sheet feeding apparatus according to claim 1, wherein said support means includes an engagement member for engaging by said first or third accommodating means.

4. A sheet feeding apparatus according to claim 3, wherein said engagement member supports said first or third accommodating means.

5. A sheet feeding apparatus according to claim 4, wherein said engagement member supports said first or third accommodating means at both sides thereof.

6. A sheet feeding apparatus according to claim 1, wherein said third accommodating means is supported in an inclined condition not to be abutted against said second sheet feeding means.

7. A sheet feeding apparatus according to claim 1, wherein said support means supports selectively and removably either of said first or third accommodating means.

8. A sheet feeding apparatus according to claim 1, further comprising:

a third sheet feeding means for feeding the sheet from said third accommodating means, and a third mounting position for mounting a fourth accommodating means accommodating sheets therein, and wherein said support means can removably support a fifth accommodating means accommodating sheets therein and having such a size as to occupy said first, second and third mounting stations.

9. A sheet feeding apparatus comprising:

a first sheet feeding means for feeding a sheet;

a first support means for supporting a first accommodating means accommodating sheets or for supporting a second accommodating means accommodating sheets therein and having a sheet accommodating capacity larger than that of said first accommodating means in a sheet feeding position;

wherein the sheet feeding apparatus forms a space when the first accommodating means is supported by said first support means, and wherein the second accommodating means occupies said space when supported by said first support means;

a second support means for supporting a third accommodating means in said space; and a second sheet feeding means for feeding the sheet from said third accommodating means supported by said second support means, wherein said first sheet feeding means and said second sheet feeding means are arranged vertically in an upper and lower relation without offset in the horizontal direction.

10. A sheet feeding apparatus according to claim 9, wherein said second support means is arranged below said first support means.

11. A sheet feeding apparatus according to claim 9, wherein said first support means includes an engagement member for engaging by said first or second accommodating means.

12. A sheet feeding apparatus according to claim 11, wherein said engagement member supports said first or second accommodating means.

13. A sheet feeding apparatus according to claim 12, wherein said engagement member supports said first or second accommodating means at both sides thereof.

14. A sheet feeding apparatus according to claim 9, further including a shift preventing means for preventing movement of said first or second accommodating means supported by said first support means.

15. A sheet feeding apparatus according to claim 9, wherein said second accommodating means is supported in an inclined condition spaced from said second sheet feeding means.

16. A sheet feeding apparatus comprising:

a first sheet feeding rotary member for feeding a sheet;

a first supporting member capable of engaging a first accommodating means accommodating sheets or a second accommodating means accommodating sheets therein and having a sheet accommodating capacity larger than that of said first accommodating means for supporting said first or second accommodating means in a sheet feeding position;

wherein the sheet feeding apparatus forms a space when the first accommodating means is supported by said first support means, and wherein the second accommodating means occupies said space when supported by said first support means;

a second support means for supporting a third accommodating means in said space; and a second sheet feeding rotary member for feeding the sheet from said third accommodating means supported by said second support member, wherein said first sheet feeding means and said second sheet feeding means are arranged vertically in an upper and lower relation without offset in the horizontal direction.

17. An image forming apparatus comprising:

a first sheet feeding means for feeding a sheet;

a first support means for supporting a first accommodating means accommodating sheets or for supporting a second accommodating means accommodating sheets therein and having a sheet accommodating capacity larger than that of said first accommodating means in a sheet feeding position;

wherein the sheet feeding apparatus forms a space when the first accommodating means is supported by said first support means, and wherein the second accommodating means occupies said space when supported by said first support means;

a second support means for supporting a third accommodating means in said space; and a second sheet feeding means for feeding the sheet from said third accommodating means supported by said second support means;

an image forming means for forming an image on the sheet fed by said first or second sheet feeding means; and a conveying means for conveying the sheet on which the image is formed by said image forming means, wherein said first sheet feeding means and said second sheet feeding means are arranged vertically in an upper and lower relation without offset in the horizontal direction.

18. A sheet feeding apparatus according to any of claims 1, 9, 16 or 17, wherein one of said first, second and third accommodating means is supported in a sloped condition relative to a horizontal direction so that a side thereof for feeding out the sheet is located than opposite side.

* * * * *

UNITED STATES PATENT AND TRADEMARK OFFICE

CERTIFICATE OF CORRECTION

PATENT NO. : 5,158,276

DATED : October 27, 1992

INVENTOR(S) : Akihiro TOMA

It is certified that error appears in the above-identified patent and that said Letters Patent is hereby corrected as shown below:

[57] ABSTRACT
Line 12, "means" should be deleted.

COLUMN 1
Line 64, "portions; portions;" should read --portions;--.

COLUMN 4
Line 33, "an" should read --a--.
Line 44, "a" should read --an--.
Line 49, "an" should read --a--.

COLUMN 7
Line 67, "an" should read --a--.

COLUMN 8
Line 24, "intermediated," should read --intermediate,--.
Line 29, "means" should read --means of--.

Signed and Sealed this

Sixteenth Day of November, 1993

Bruce Lehman

*Attest:*

BRUCE LEHMAN

*Attesting Officer*

*Commissioner of Patents and Trademarks*